United States Patent [19]

Eaulconer et al.

[11] Patent Number: 4,810,134

[45] Date of Patent: Mar. 7, 1989

[54] SINGLE WALLED DIVER'S BUOYANCY COMPENSATOR

[75] Inventors: Mark Eaulconer, Costa Mesa; Scott E. Greatrake, Santa Ana, both of Calif.

[73] Assignee: U.S.D. Corp, Santa Ana, Calif.

[21] Appl. No.: 37,621

[22] Filed: Apr. 13, 1987

[51] Int. Cl.[4] ..... B63C 9/16

[52] U.S. Cl. ..... 405/186; 405/185; 441/118; 441/108; 441/88

[58] Field of Search ..... 405/186, 185; 441/88, 441/90, 92, 96, 99, 106, 108, 111, 115, 118, 119, 123

[56] References Cited

U.S. PATENT DOCUMENTS

| | | | |
|---|---|---|---|
| 1,046,068 | 12/1912 | Hebs | 441/111 |
| 1,544,672 | 7/1925 | Milbury | 441/123 |
| 2,346,019 | 4/1944 | Gerich | 441/108 |
| 2,742,654 | 4/1956 | Hurt | 441/118 |
| 2,869,152 | 1/1959 | Anderson | 441/111 X |
| 3,090,205 | 5/1963 | Hurwitz et al. | 405/186 |
| 3,329,982 | 7/1967 | Zannoni | 441/118 X |
| 3,436,777 | 4/1969 | Greenwood | 405/186 |
| 4,523,914 | 6/1985 | Faulconer et al. | 441/106 X |
| 4,681,552 | 7/1987 | Courtney | 441/115 X |

*Primary Examiner*—Dennis L. Taylor

*Attorney, Agent, or Firm*—George F. Bethel; Patience K. Bethel

[57] ABSTRACT

The invention described herein is a buoyancy compensator for a diver having a single thickness wall formed of substantially non-stretchable material that has been coated with a meltable plastic. The buoyancy compensator walls on the interior portion with the meltable plastic are adhered to each other in rounded areas or ribs having rounded ends to avoid stress when the buoyancy compensator is under pressure and provide a conformation to the buoyance compensator with a limitation of expansion in different areas of the walls of enhancement of the overall configuration and improved buoyancy relationship of a diver at a particular portion of the buoyancy compensator. The entire buoyancy compensator is served by inflation means and overexpansion gas valving means. The buoyancy compensator is fitted and secured by means of belts and shoulder straps for respective waist adjustment and shoulder and side portion adjustment.

22 Claims, 3 Drawing Sheets

SINGLE WALLED DIVER'S BUOYANCY COMPENSATOR

BACKGROUND OF THE INVENTION

This invention pertains to diving equipment. More particularly, it pertains to diving equipment in the form of buoyancy compensators or vests. It is specifically directed toward a buoyancy compensator vest having a single walled configuration for conformance to a user's body and shaping thereof during use.

THE PRIOR ART

The prior art of buoyancy compensators for divers constitutes a multitude of various buoyancy compensation means. Such buoyancy compensation means are used to help maintain a diver's buoyancy at a neutral point while diving. As can be appreciated, the further a diver dives under water, the greater the pressure. Accordingly, the small interstices of a diver's wetsuit and the generally buoyant gas compresses. The diver changes his relative degree of buoyancy at various degrees of depth due to the foregoing compression.

In order to overcome this problem, the prior art has evolved what are commonly known as buoyancy compensators. These buoyancy compensators allow for variable amounts of air from the diver's diving tank to be introduced into the buoyancy compensator. Such variable amounts of air allow for changing the relative buoyancy of the diver at various depths. By increasing the relative mass of air in the buoyancy compensator the diver at lower depths can increase his relative buoyancy at such a depth and thereby trim himself to a neutral state. Of course, when ascending, air is released in order to adjust for the particular buoyancy requirements at the lessened depth.

The entire thrust of buoyancy compensators and their respective function is to provide for a generally neutral buoyancy to a diver.

In the past, such buoyancy compensators have comprised simple devices in the form of vests that are analogous to life jackets, vests that have front and back support portions, as well as various other configurations in order to allow for the buoyancy compensator to accommodate itself to a diver's body shape.

Conformable buoyancy compensators have been provided in the form of the buoyancy compensator shown in U.S. Pat. No. 4,523,914. Furthermore, other buoyancy compensators such as that shown in U.S. Pat. No. 4,000,534 exist. As can be seen from the foregoing buoyancy compensators in the two cited patents of the prior art, one of them attempts to provide a buoyancy compensator that conforms to a user's body. The other attempts to solve the problem with regard to the use of a bladder and an inflator in combination therewith.

The foregoing prior art and the other known prior art constitute buoyancy compensators having double bags or double walls. The outer bag generally provides for the maintenance of pressure within the buoyancy compensator. The inner bag provides for a maintenance of the air therein in a sealed relationship. The inner bag or bladder is generally impermeable to the passage of air and maintains the air in a sealed relationship. The relative expansion thereof is controlled by the outer bag or buoyancy compensator cover.

As can be seen from the two foregoing patents, particularly the patent showing the conformable buoyancy compensator, U.S. Pat. No. 4,523,914, various attempts have been made to cause the bladder to conform to a user's body. These attempts have not been effective with regard to providing conformability, nor with regard to the overall effectiveness of buoyancy compensators. This invention maintains a buoyancy compensator in a generally conformable relationship by means of a single bag or wall thickness orientation. There is no need for a bladder in the instant invention, and the buoyancy compensator conforms to a user's body in an easy and facile manner.

When considering the invention hereof, it can be seen that a large step over the art has been made with respect to providing a buoyancy compensator with only a single bag and without a bladder. Both the outer and inner wall materials provide the function of maintaining conformance of the buoyancy compensator to a user's body configuration. Additionally, the buoyancy compensator hereof is conformed by means of various heat set rounded portions, ribs, circles and oblong orientations.

The invention also allows for the attachment of fixtures belt loops, and various accessories to a buoyancy compensator by means of heat setting a rounded area in a circular peripheral portion while allowing the area therebetween to provide for a passage through the buoyancy compensator from one wall to the next. This thereby allows for an improved attachment of fixtures, including belt loops and other attachments which are necessary for the proper maintenance and function of a buoyancy compensator.

This invention should be read broadly in light of the prior art as to providing not only a buoyancy compensator of improved qualities as to conformability, but also with greater strength and capability of attaching fixtures to the buoyancy compensator all by means of a single bag or single walled buoyancy compensator configuration without the requirement of a separable bladder.

SUMMARY OF THE INVENTION

In summation, this invention comprises a buoyancy compensator having inflation means and safety relief valve means for providing buoyancy compensation while at the same time carrying a tank of breathing gas. The buoyancy compensator is conformed by means of rounded adhering portions and provides rounded openings that are sealed internally to allow fixtures to pass through openings in the buoyancy compensator walls.

More particularly, it comprises a buoyancy compensator formed with a chamber between two walls. It incorporates a single bag or walled concept rather than a bladder and outer pressure maintenance walls. The two walls are formed of material that has an interior coating that allows a sealing of the walls to one another in a pre-selected pattern when heatset in any suitable manner.

The buoyancy compensator is formed in a configuration with the internal portions of the walls and their heatsetting material providing for a peripheral heatset to seal the edges of the buoyancy compensator. Interior wall heatsetting in a rounded connected pattern allows for the general conformation of the buoyancy compensator to be maintained by means of keeping certain portions within a non-expandable pattern. The non-expanded portions are adhered to each other by means of internal heatsetting so that they do not expand into a realm bloated or overexpands the general conformation that is desired in a buoyancy compensator. This allows the buoyancy compensator to conform to a user's body.

Fixture attachments on the buoyancy compensator walls are provided in part by through holes through the walls of the buoyancy compensator. These through holes of the buoyancy compensator are such wherein they are sealed around the holes by means of heatsetting the periphery around the holes. Thus, a fixture can be attached to the buoyancy compensator such as a belt loop for attachment of the buoyancy compensator to such fixtures that are used for diving with the buoyancy compensator.

The buoyancy compensator includes adjustable straps for allowing the shoulder portions of the buoyancy compensator to be pulled into adjustment with the waist portions. The waist is secured by means of a waist band portion of the buoyancy compensator that terminates in a webbed belt attachment.

The buoyancy compensator has a provision for a backpack and a tank attached thereto. The tank is for breathing gas and allows for the supplemental filling and pressurization of the buoyancy compensator.

An oral and automatic inflator is provided to fill the buoyancy compensator. Also, a relief valve provides for the exhaust of air upon overinflation or when it reaches a critical point of expansion.

As will be seen hereinafter, this invention is a significant step with regard to a narrow portion of the art for providing buoyancy compensation through a single bag or bladderless buoyancy compensator.

BRIEF DESCRIPTION OF THE DRAWINGS

The invention will be more clearly understood by reference to the description below taken in conjunction with the accompanying drawings wherein.

DETAILED DESCRIPTION OF THE PREFERRED EMBODIMENTS

Figure 1:
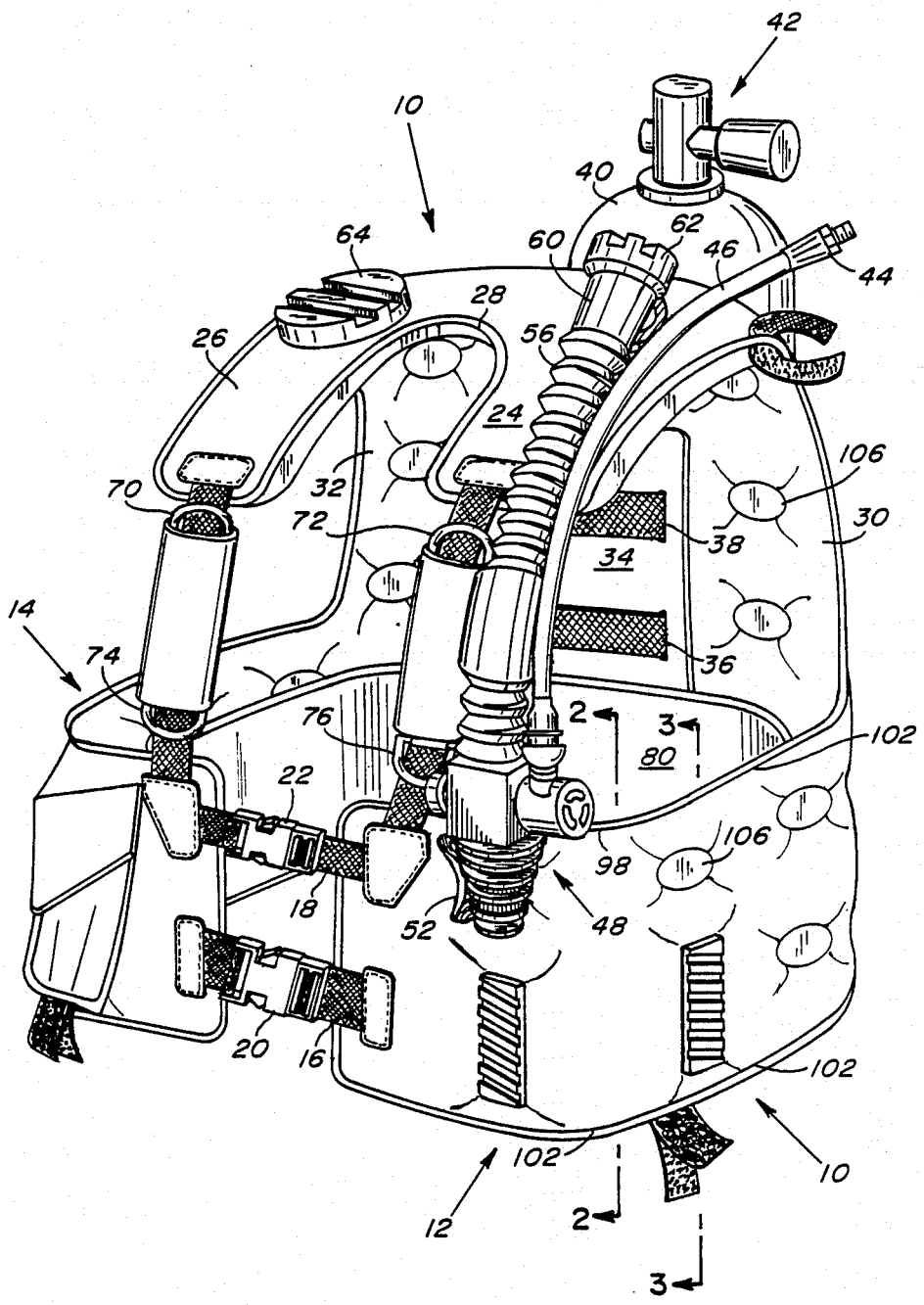
FIG. 1 shows a perspective view of the buoyancy compensator of this invention with the attachment and fixtures thereof.

Looking particularly at FIG. 1, it can be seen wherein a buoyancy compensator 10 is shown. The buoyancy compensator 10 has a pair of waist portions 12 and 14 which terminate in webbed belts 16 and 18. The webbed belts have buckles 20 and 22 in order to secure the waist portions 12 and 14 around a user's waist. Two shoulder portions 24 and 26 surround a neck area 28 that terminates in a back portion divided into two portions 30 and 32. The back portions 30 and 32 receive a resilient and stiff backpack 34 therebetween having webbed belts 36 and 38.

The webbed belts 36 and 38 pass through slotted openings of the backpack 34 and surround a tank of breathing gas 40. The tank of breathing gas has a valve and regulator generally shown as valve and regulator 42. The valve and regulator 42 serve to provide breathing gas to a breather. Furthermore, the intermediate pressure therefrom can be delivered to a fixture 44 for connection therewith to deliver intermediate pressure through a tube 46.

The tube 46 is connected to an oral and automatic inflation fixture 48. The oral and automatic inflation fixture has a mouthpiece 52 through which a user can inflate the buoyancy compensator orally. Also, a valve is provided on the fixture 48 to allow the introduction of intermediate pressure through the tube 46 into the buoyancy compensator. Both of the foregoing flows from oral inflation efforts or intermediate pressure from tube 46 are delivered through a corrugated tube 56 to the interior of the buoyancy compensator. The corrugated tube 56 terminates in an L fitting 60 which is partially hidden from view, that delivers the gas into the buoyancy compensator.

The foregoing allows for filling of the buoyancy compensator for providing various masses of gas therein for buoyancy compensation. In order to bleed the buoyancy compensator from air pressure, the tube 56 is pulled downwardly at which time a cable internally thereof allows a dumping valve to unseat within the L shaped fixture 60 for exhaust out of a grated opening 62.

When overinflation or excess pressure is encountered, a relief valve that has a grating 64 thereover allows for the exhaust and bleeding of pressure in the buoyancy compensator out of the relief valve.

In order to adjust the shoulder areas 24 and 26 with respect to the side portions 12 and 14, looped D rings on adjustment straps are shown. These D rings are D rings 70 and 72, as well as D rings 74 and 76 which allow the adjustment of the shoulder areas 24 and 26 with respect to the side portions 12 and 14. The details thereof are seen in U.S. patent application Ser. No. 946,527, filed Dec. 23, 1986 entitled Buoyancy Compensator with Adjustable Strap, inventor Mark Faulconer and which is incorporated herein by reference.

The buoyancy compensator is also provided with an internal belt 80. The internal belt 80 circumscribes the interior of the side portions and the back of the buoyancy compensator and is made of elastomeric material in the form of an elastomeric foam. The elastomeric foam is generally that of the same type of material which is used for a wetsuit. Thus, upon descent and ascent, the belt 80 expands and contracts due to the increase and decrease of pressure on the cellular foam material and the cells therein. This thereby adjusts the holding of the buoyancy compensator for its retention around a user's waist. This can be seen in U.S. patent application Ser. No. 745,492, naming Mark Faulconer as inventor and filed June 17, 1985, which is incorporated herein by reference.

Figure 2:
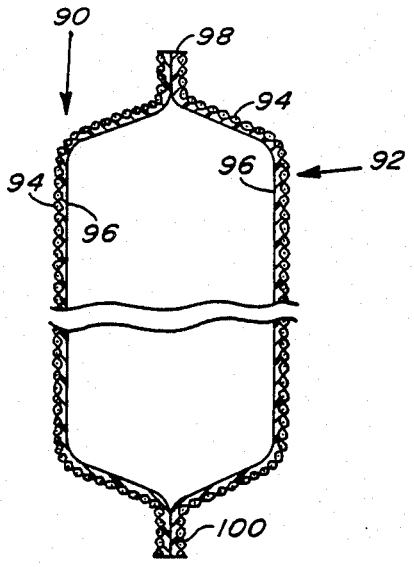
FIG. 2 shows a sectional view in the direction of lines 2—2 of FIG. 1 wherein the internal portion of the buoyancy compensator is shown with the peripheral sealing along the edges thereof.
Figure 3:
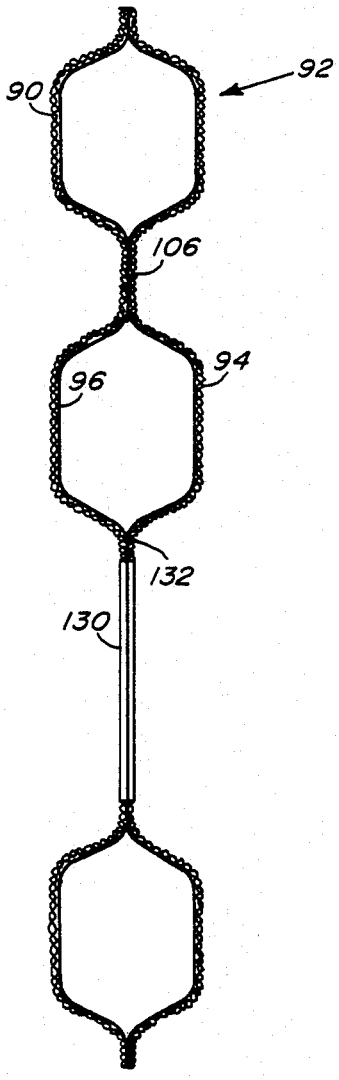
FIG. 3 shows a sectional view in the direction of lines 3—3 of FIG. 1 showing the interior of the buoyancy compensator and the adhering rounded portions in sealed relationship as well as a through hole for providing a fixture in the form of a belt loop attached to the buoyancy compensator.

Looking more particularly at FIGS. 2 and 3, it can be seen wherein buoyancy compensator wall portions 90 and 92 are shown. The wall portions 90 and 92 comprise firstly the surface exposed to the body of an individual such as that of the side portions 12 and 14. This is in the form of wall 90. Wall 92 is exposed to the outer side as can be seen.

The buoyancy compensator walls 90 and 92 form a single walled chamber and are made from a material which is characterized as pack cloth. The pack cloth is a gas permeable woven nylon cloth made by weaving fabric. This can be seen in the woven structure of the pack cloth 94. The woven structure of the pack cloth 94 is coated internally within the interstices between the warp and the fill of the cloth by means of a heatsealable and heat meltable urethane coating. This is seen as a coating 96. This coating 96 fills the interstices between the warp and the fill of the cloth weaving 94. Thus, the heatsealable material internally in the form of the urethane coating provides for impermeability to the air therein to prevent it from escaping through the interstices of the pack cloth 94. The pack cloth is relatively non-stretchable to provide for maintenance of pressure in the buoyancy compensator.

The cloth 94 can be substituted by non-woven fabrics or other materials which can withstand the pressure in the buoyancy compensator. Also, internal coatings providing impermeability to air in the bouyancy compensator can be used with or as an adjunct to the reinforcing or stress bearing cloth 94. Furthermore, the cloth 94 and coating can be made as a single material without the separate two part system. The main emphasis should be that the internal portions of the walls 90 and 92 when exposed to each other can be heatset or adhered within the chamber.

The walls 90 and 92 are shown with a heat sealed periphery 98 and 100. This seals the outer edges to form the interior chamber between the walls 90 and 92. The heat sealed periphery 98 and 100 are trimmed with a tape 102 around the edges. This tape 102 is not seen in the showing of FIGS. 2 and 3 but is shown in FIG. 1 as surrounding the peripheral regions of the edges of the buoyancy compensator.

Looking more particularly at FIG. 3, it can be seen wherein a heatset area 106 is shown. The heatset area 106 is a rounded circular area that has been heatset by means of causing the heat sealable urethane to adhere to either side. This can be done in the same manner that the edges 98 and 100 are heatset to each other.

The heatsetting 106 can be provided by radio frequency (RF) welding, ultrasonic welding, thermal heatsealing or any other suitable sealing process. The idea is to be able to melt the urethane coating and cause a sealing between the two respective inside portions of walls 90 and 92 so that the buoyancy compensator walls 90 and 92 are brought into connection with each other.

A further criteria is that the heatset areas be rounded. This rounding can be in the form of the elipse as shown in FIG. 1, a circle, a dot pattern or elongated areas that are rounded at their ends or stress points. The heatsetting can also be such wherein only a ring dot is heatset with an internal portion allowed to be open or free from heatsetting and the external portion exposed to the chamber providing a mini-chamber in the ring.

Figure 5:
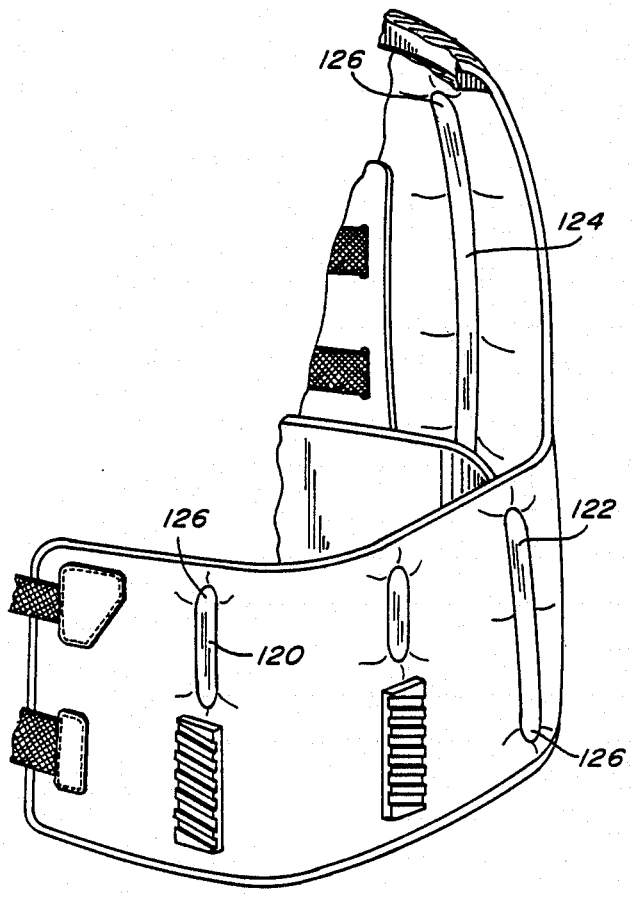
FIG. 5 shows an alternative view of the buoyancy compensator wherein the interior adhering portions are formed as elongated rounded ribs.
Figure 6:
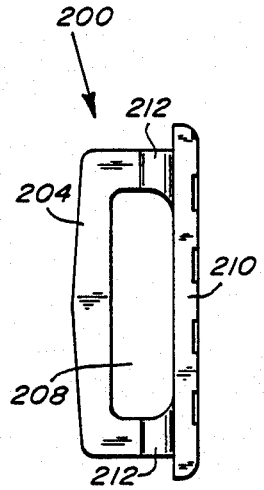
FIG. 6 shows a loop that is used for a belt loop for the buoyancy compensator.

As an alternative to the foregoing rounded configurations 106 which are heatsealed areas between the respective walls 90 and 92, elongated ribs 120 and 122 can be utilized as shown in FIG. 5. The elongated ribs 120 and 122 are heatset in the same manner as the rounded bonded portions 106. In some cases this can provide for greater body conformation, by the elongated ribs 124 shown having rounded end regions 126 of rib 120 and rounded end region 126 of rib 122.

The reason for the rounded areas such as circles, dots, elipses, and those at the ends of ribs 120, 122 and 124 is to prevent tearing and stress such as at the ends of the ribs. When the buoyancy compensator is under pressure, it causes substantial expansion and when the respective heatset areas such as 106 or the ribs 120, 122 and 124 are in connected relationship, there is a tendency for the heatset areas to pull away under stress. To avoid stress points, a rounded area is utilized, such as the rounded areas 106. The rounded heatset areas should be utilized in order to secure the walls of the buoyancy compensator, namely walls 90 and 92 to each other for the conformation. In effect stress points concentrated at sharp corners or relative small areas of stress concentration should be eliminated.

The conformation of the buoyancy compensator is retained by the respective heatset areas 106 and ribs 120, 122 and 124 to prevent undue expansion. Without the foregoing heatset areas, the buoyancy compensator would balloon out and would be fundamentally nothing other than a cumbersome blown up bag on a user's body. With the maintenance of the heatset areas 106, and ribs 122 and 124, it can be seen wherein the entire bag formed by walls 90 and 92 can be shaped and conformed when it is in its expanded state to generally conform to a user's body.

The conformation of the buoyancy compensator can assume any body conformation with the foregoing adhering areas. The ribs or rounded areas provide for limited areas of expansion. When the density of more rounded areas or ribs are used the expansion is obviously less. Thus, not only can the conformation to a body be tailored, but the relative positions of positive buoyancy can be increased or decreased. This is due to the relative amount of gas that can be distributed through the buoyancy compensator thereby placing the gas in a respective displacement area depending upon the amount of buoyancy desired.

Figure 4:
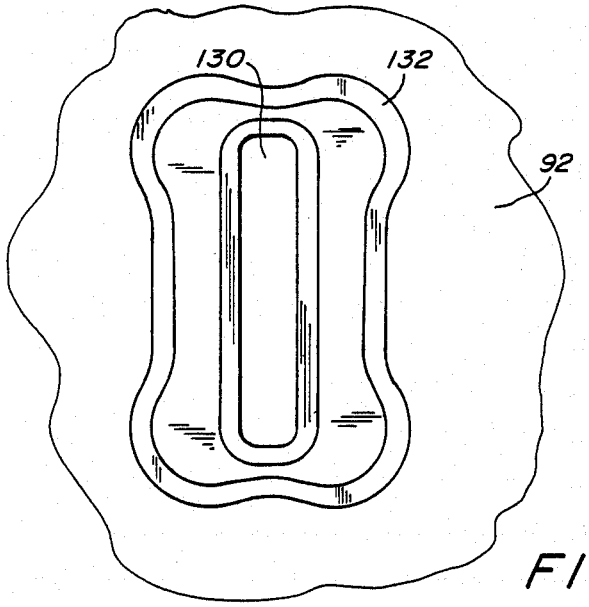
FIG. 4 shows a view of an opening of the buoyancy compensator passing through the buoyancy compensator walls.

With this concept, it is necessary to provide for fixtures to the buoyancy compensator without causing it to leak. In order to do this, the inventors have determined that a fixture or fastener can be provided through openings such as in FIG. 4. The through opening in FIG. 4 is generally an opening 130 having a heatset area 132 surrounding the opening 130, IN the walls 92 and 92. This can be seen generally in both FIGS. 3 and 4. This allows for the through opening 130 to create a means for attaching a fixture such as that shown in FIGS. 6 through 9 or any other suitable fixture. The sealed area 132 surrounding the opening 130 allows for strength and at the same time prevents pressure from escaping from the opening 130.

Figure 7:
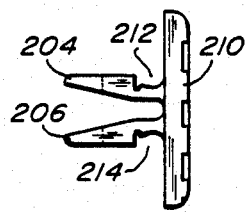
FIG. 7 shows a side view of the loop shown in FIG. 6.

In order to connect the inside belts or in particular a buoyancy compensator belt such as belt 80 to be attached to the side and back portions of the buoyancy compensator, snap-in rings and loops are provided. The snap-in loop is shown as loop 200. Loop 200 comprises a pair of tines 204 and 206 as can be seen in FIG. 7. The tines 204 and 206 are looped or formed upwardly around an opening 208. The opening 208 allows for a belt to pass therethrough. The opening 208 is within both tines 204 and 206. The tines 204 and 206 terminate at a base 210. The base 210 is ribbed for reasons of strength and appearances.

Each tine 204 and 206 has an inset 212 and 214. The inset 212 and 214 receives a loop or ring such as the loop shown in FIGS. 8 and 9.

The tines 204 and 206 are resiliently spread outwardly. They angle in a manner so that when they are compressed inwardly toward each other, they provide for a resilient retention of the ring that is snapped thereover. The ring, when snapped thereover, locks into the insets 212 and 214 so that it retains the loop in the inserts 212 and 214.

Figure 9:
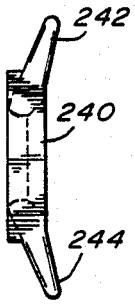
FIG. 9 shows an end view of the ring as seen in FIG. 8.
Figure 8:
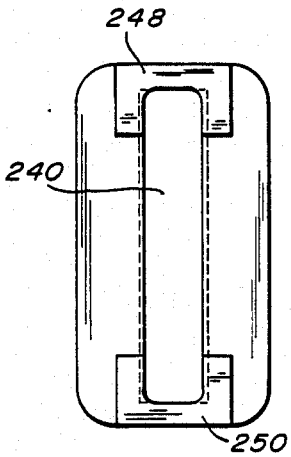
FIG. 8 shows a snap ring for snapping over the tines of the loop shown in FIGS. 6 and 7.

The loop as seen in FIGS. 8 and 9 has an opening 240 which surrounds the tines 204 and 206 and when slid thereover compresses them together toward each other and is then received in the undercuts 212 and 214. The loop in FIGS. 8 and 9 is provided with a flared pair of side portions 242 and 244 so that when the loop is passed over the tines 204 and 206 it allows for the maintenance of the material therein in a tightened manner against the shoulders of the loop, namely shoulders 248 and 250.

With the foregoing in mind, a belt or any other fixture can be connected through the opening 208 of the attachment system shown in FIGS. 6 through 9. Any other suitable fixture can be utilized to pass through the opening such as opening 130 shown in FIG. 4 for retention of fixtures and portions of the buoyancy compensator.

From the foregoing, it can be seen that this invention is a step over the prior art by allowing for a single walled buoyancy compensator without a supplemental bladder established between walls 90 and 92. It prevents the tearing of the conformation affixing points, or rounded portions such as 106 or ribs 120, 122 or 124 by the rounded end portions 126 or the round dot-like configurations 106 that are adhered heatset together. As a consequence, this invention is a substantial step over the art by providing for a single walled buoyancy compensator. It is one which is inherently capable of conforming to a user's body once the configuration and conformation is established by the appropriate set points in the form of the ribs or the adhesion points described hereinbefore.

We claim:

1. A buoyancy compensator for providing buoyancy to a diver formed in a configuration having side portions, shoulder portions and a back portion wherein the side portions are held by a belt across a user's waist and the shoulder portions and side portions are interconnected by a belt and having a means for receipt of a tank of breathing gas wherein the improvement comprises:

a single walled chamber for receiving buoyancy compensating gas therein with single walls on either side that are held together at the edge regions;

a plurality of generally rounded bonded portions between the inner surfaces of the walls of the buoyancy compensator for bonding the walls together at rounded portions; and wherein, said walls are formed of generally non-stretchable material with a plastic means to provide for fluid impermeability and wherein the plastic means is bonded between on respective inner portion of a wall and the other inner portion of a wall at the rounded bonded portions to provide for controlled expansion by the bonded portions.

2. The buoyancy compensator as claimed in claim 1 wherein the material for the buoyancy compensator comprises:

a permeable generally non-stretchable material having interstices that have been coated with a plastic material filling the interstices to provide for fluid impermeability through the interstices and wherein the plastic coated material is bonded between one respective inner portion of a wall and the other inner portion of a wall at the rounded bonded portions.

3. The buoyancy compensator as claimed in claim 2 wherein:

said plastic coating is a urethane coating.

4. The buoyancy compensator as claimed in claim 3 wherein:

said rounded bonded portions between the respective walls are established by heat setting of the two respective walls on the interior surfaces thereof in the chamber into adhered relation by heat setting of the plastic into a melted relationship for bonded adherence.

5. The buoyancy compensator as claimed in claim 4 wherein:

said adhered rounded bonded portions comprise circular bonded portions between the inner wall surfaces of said buoyancy compensator.

6. The buoyancy compensator as claimed in claim 4 wherein:

said adhered rounded bonded portions comprise elongated ribs having rounded ends thereof.

7. The buoyancy compensator as claimed in claim 1 further comprising:

through openings passing through said buoyancy compensator, and wherein the periphery of the openings have been heatset between each respective inner portion of the walls to provide for fixtures passing therethrough.

8. The buoyancy compensator as claimed in claim 7 further comprising:

fixtures passing through the through openings for receipt of a belt.

9. A buoyancy compensator for providing a diver with buoyancy compensation comprising:

walls forming an interior chamber wherein the walls are formed as two side portions for circumscribing at least in part a user's waist and a shoulder portion for overlying a user's shoulders around a user's neck and having a back portion thereof;

belt means for securing, the side portions into fitting relationship around a user's waist;

strap means attached between the shoulder portions and the side portions for holding the respective side portions and shoulder portions in connected relationship thereto and for adjustment of the shoulder portions to the side portions;

a backpack attached to the back portion of the buoyancy compensator for receipt of a tank of breathing gas thereon;

filling means for filling the buoyancy compensator with gas;

said walls of said buoyancy compensator comprising a fabric;

a plastic coating on the fabric to prevent the permeation of fluid therethrough; and rounded adhered portions between the interior wall surfaces of the buoyancy compensator adhering the plastic coating on one wall surface to the other to control expansion of the respective walls when the buoyancy compensator is inflated.

10. The buoyancy compensator as claimed in claim 8 wherein:

said plastic material comprises a heat sealable urethane; and wherein, said rounded adhered portions between the walls of said buoyancy compensator are adhered by partially melting the urethane.

11. The buoyancy compensator as claimed in claim 10 wherein:

said adhered portions are rounded adhered portions formed generally as circular portions.

12. The buoyancy compensator as claimed in claim 10 wherein:

the adhered portions are formed as elongated ribs terminating in rounded end portions.

13. The buoyancy compensator as claimed in claim 11 further comprising:

openings passing through the buoyancy compensator walls from one side to the other for clear passage therethrough which have been heatset around the periphery of the openings for receipt of fixtures passing therethrough.

14. The buoyancy compensator as claimed in claim 13 wherein:

the openings receive fixtures having a broadened base on one side with tines extending therethrough and a loop for engagement of the tines on the other side of the buoyancy compensator for affixation of a buoyancy compensator belt to the fixture.

15. A buoyancy compensator formed as a single walled buoyancy compensator comprising:

a coextensive pair of walls joined at the periphery forming an interior chamber wherein each of said walls is configured to provide a waist area for surrounding in part a user's waist, a shoulder area overlying the shoulder of a user and a back area for overlying the back of a user wherein said shoulder area and waist area are connected by shoulder straps therebetween; and, wherein said coextensive walls are made of a normally gas permeable material whose interstices exposed to said chamber have been filled with a plastic coating; and, wherein said two walls formed of said permeable material and said plastic coating are joined at the edge regions by melting the plastic coating at the edge regions and forming rounded adhesion points between said walls by melting the plastic material coating said walls so as to control expansion of the buoyancy compensator walls.

16. The buoyancy compensator as claimed in claim 15 wherein:

said buoyancy compensator walls are formed of a woven fabric; and, wherein the interstices of said buoyancy compensator interior walls are coated with a urethane plastic.

17. The buoyancy compensator as claimed in claim 16 wherein:

said walls are adhered together with rounded adhesion points.

18. The buoyancy compensator as claimed in claim 16 wherein:

said walls are adhered at least in part as elongated ribs which are rounded at the ends thereof.

19. The buoyancy compensator as claimed in claim 16 wherein:

said walls are adhered to each other by RF welding.

20. The buoyancy compensator as claimed in claim 16 wherein:

said walls are adhered by heatsealing and melting part of the plastic between each respective wall.

21. The buoyancy compensator as claimed in claim 16 further comprising:

an opening passing between the walls that is heatsealed around the periphery thereof for mounting of fixtures to the buoyancy compensator.

22. The buoyancy compensator as claimed in claim 21 further comprising:

a fixture passing through the opening for receipt of a belt; and wherein, said fixture comprises a base member having extending tines on one side wherein the tines pass through the openings and receive a loop on the other side over said tines.

* * * * *